United States Patent [19]

Schmid

[11] Patent Number: 4,650,274

[45] Date of Patent: Mar. 17, 1987

[54] WELD-ON NUT FOR GROUNDING TERMINAL

[75] Inventor: Dieter Schmid, Aidlingen, Fed. Rep. of Germany

[73] Assignee: Daimler-Benz Aktiengesellschaft, Fed. Rep. of Germany

[21] Appl. No.: 682,614

[22] Filed: Dec. 17, 1984

[30] Foreign Application Priority Data

Dec. 16, 1983 [DE] Fed. Rep. of Germany ..... 3345617

[51] Int. Cl.[4] ..... H01R 4/38

[52] U.S. Cl. ..... 339/263 E; 339/14 R; 339/278 C; 339/263 B

[58] Field of Search ..... 339/263 R, 263 B, 263 E, 339/278 C, 232, 14 R

[56] References Cited

U.S. PATENT DOCUMENTS 1,460,969 7/1923 Koretzky ..... 339/263 B
3,432,793 3/1969 Muska et al. ..... 339/263 E

FOREIGN PATENT DOCUMENTS 2844384 4/1980 Fed. Rep. of Germany .
647312 12/1950 United Kingdom .
775724 5/1957 United Kingdom .
838173 6/1960 United Kingdom .
1115486 5/1968 United Kingdom .

*Primary Examiner*—Gil Weidenfeld
*Assistant Examiner*—Paula A. Austin
*Attorney, Agent, or Firm*—Barnes & Thornburg

[57] ABSTRACT

A weld-on nut is welded to a metal component to form a portion of a battery grounding terminal. The weld-on nut is tinned or galvanized with an anti-corrosion metal coating. The weld-on nut is welded to the associated sheet metal component by means of an electric resistance welding operation. In order to protect the contact surface from fusion of the tinning by welding spatters, an electrode contact surface on the nut is arranged axially offset relative to an electrode abutment surface or transversely to the latter. This weld-on nut can be of extremely light and small construction. The nut also requires provision of only a relatively small centering hole in the sheet metal in the region of the welding position, whereby the sheet metal component is only very slightly weakened.

6 Claims, 2 Drawing Figures

WELD-ON NUT FOR GROUNDING TERMINAL

BACKGROUND AND SUMMARY OF THE INVENTION

The invention relates to a nut that is welded onto a sheet metal component to provide a grounding terminal for a battery, and particularly to a weld-on nut having a annular flange for use with electrical resistance welding equipment.

It is customary to provide a battery in motor vehicles for powering a vehicle electrical system. The negative pole of the battery is coupled to a plurality of electrically powered devices through the electrically conductive metal body parts of the vehicle. For this purpose it is necessary to provide an electrically conductive connection between the negative pole of the battery and the vehicle body at the so-called grounding terminal. Because the vehicle electrical system has an extremely low voltage, 12 volts for example, it is important for the electrical resistances to the electrically powered devices to be as small as possible. A weld-on nut is generally provided at the ground connection points, so that a grounding strap can be screwed into position with high specific pressure and good electrical conductivity. It is important to provide a ground connection having good electrical contacts which are durable at long term and are not susceptible to damage as by rust or the like. A very large number of electrical power consuming elements are typically installed in a motor vehicle. A grounding terminal can be coupled to an individual electrically powered device or to a group of nearby electrically powered devices.

The grounding terminal according to German unexamined Published Patent Application No. 2,844,384 discloses a tinned weld-on nut, which is welded to the vehicle body using electrical resistance welding techniques and welding bosses. In fact, the weld-on nut includes a circular lug which protrudes through a corresponding aperture in the vehicle body. The length of the lug corresponds to the sheet metal thickness of the vehicle body sheets. The end face of this lug forms the contact surface for the grounding terminal and is located to lie flush with one side of the sheet metal. The weld-on nut itself is located on the other side of the sheet metal, as is the screwing side for the grounding terminal.

The weld-on nut is tinned or galvanized to prevent corrosion of the contact surface over the long term and thereby ensure good electrical contact to ground for long periods of time. However, the welding process, and in particular the flight of sparks from the resistance welding operation, operates to partially fuse and remove the protective tinning so that starting points for the undermining of the contact surface by rust exist. Although the prior publicaton quoted discloses a mushroom-shaped rubber part which is drawn through the weld-on nut to cover the contact surface, this means of protection is not yet present on the weld-on nut during the welding operation since it is employed only during the painting phase of the vehicle body and after the weld-on nut has already been welded. The rubber material would also not be at all suitable to effectively protect the contact surface from damage coused by fusion of the anti-corrosive tinning which is often induced by the welding spatters.

Another disadvantage of the previously known grounding terminal lies in the fact that a relatively large aperture has to be made in the vehicle body sheet in the fastening region of the weld-on nut. Such an aperture is undesirabe partly from strength consideration, but also from consideration of relialbe water sealing.

In accordance with the presnet invention, a nut for use in to grounding terminal includes at least one electrode abutment surface for receiving a resistance welding electrode and contact surface. Both the electrode abutment surface and the contact suface are coated with the anti-corrosive metal. The contact surface is offset in spaced-apart relation to the electrode abutment surface to protect the contact surface from damage due to spattering during welding of the nut to a metal component.

The aim of the invention is to disclose a weld-on nut for use in a grounding terminal, the weld-on nut including a contact surface protected from corrosion at long term even after the electrical resistance welding. Further, the weld-on nut is desirably fastenable to the vehicle body surface using no perforation at all. In the present invention, at most one perforation corresponding approximately to the screw diameter need be provided in the region of the fastening point of the weld-on nut.

The abutment surface is effectively protected from welding spatters due to the mutual offset, or the mutually transverse position, of the electrode abutment surface and the contact surface of the weld-on nut. Thus, the anti-corrision metal coating of the weld-on nut remains undamaged at this point in spite of any intensive welding spatters. On the contrary, the welding spatters are diverted by the offset, or, in the case of mutually transverse positioning of the surfaces, guided past the contact surface. The weld-on nut is welded onto the same side of the vehicle body sheet that a threaded grounding bolt or other fastening screw is subsequently mounted. A small lug can be provided on the weld-on nut that is concentrically alignable in relation to the tapped bore when it is desirable to positively fix the weld-on nut in a selected position prior to welding. The small lug protrudes into a corresponding aperture in the vehicle body sheet and need only be slightly larger than the diameter of the threaded grounding bolt. If a corresponding preliminary fixing of the weld-on nut is omitted, then a corresponding perforation may be totally omitted, whereby the vehicle body remains water-tight at the fastening point of the weld-on nut. The vehicle body sheet may be formed to include hat-shaped depression at the fastening point of the grounding bolt whenever it is necessary to make space on the underside of the weld-on nut for the passage of the threaded grounding bolt. The vehicle body is weakened very little, or not at all, at the fastening point due to the fact that only a relatively small centering aperture, or possibly no aperture at all, is required.

Further objects, features, and advantages of the present invention will become more apparent from the following description when taken with the accompanying drawings which show, for purpose of illustration only, an embodiment in accordance with the present invention.

DETAILED DESCRIPTION OF THE DRAWINGS

FIG. 1 is a sectional view of grounding terminal embodying the present invention, and FIG. 2 is a side elevation view of the weld-on nut of FIG. 1, with portions broken away, showing positioning of resistance welding electrodes on the weld-on nut during the welding operation.

BRIEF DESCRIPTION OF THE DRAWINGS

The ground connection point illustrated in FIG. 1 consists of a sheet metal component 1 having a passage hole 6, into which a preferably cylindrical weld-on nut 4 with centering stud 8 has been inserted. Because the external diameter of the centering stud 8 is only slightly greater than the screwthread diameter D of the weld-on nut 4 (e.g., an external diameter of approximately 1.4 to 1.6×D is sufficient in this respect) it is possible to adopt a correspondingly small passage hole 6 in the sheet metal component 1. The strength characteristic of the sheet metal component is weakened only slightly by this means. In order to obtain secure centering, the centering stud should be at least approximately as long as the sheet metal thickness s. In addition to a centering and provisional fixing of the position of the weld-on nut before the welding, the centering stud, and/or the screwthreads provided thereon, also contribute to the support of the screwthread forces, so that the weld-on nut can be made thinner and lighter.

A contact surface 5, tinned, for example, is present on that side remote from the centering stud 8 and from the welding side of the nut. An annular electrode abutment surface 12, is provided all round the contact surface, and is axially offset toward the sheet metal component 1 in addition to the contact surface 5 by an offset 11. A resistance welding electrode 10 may be applied to the annular electrode abutment surface 12 as shown in FIG. 2. In practice, an electrode is drilled at its end face so that an annular flange remains. The electrode 10 can be applied to the electrode abutment surface 12. The lower resistance welding electrode 10 is also machined away centrally on its end face, to enable it to accommodate the centering stud or a small protrusion of the latter. The weld-on nut is provided with a plurality of welding bosses 9 on its side facing the sheet metal. The welding bosses 9 may be produced by deformation, or also, by a cutting operation involving hollow conical machining in the edge region (e.g., in the case of a square head nut). Welding of the weld-on nut to the basic material of the sheet metal component 1 occurs in the region of the welding bosses, resulting in good and durable electrical contacting. Tinning or galvanizing of the weld-on nut, operates to provide an effective cathodic protection from corrosion in the welding region notwithstanding the lack of corrosion protection on the sheet metal component in the region covered by the weld-on nut.

Figure 1:
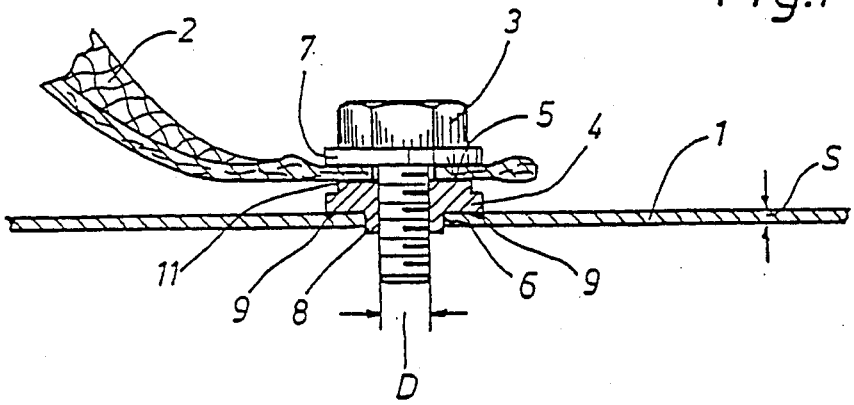
Figure 2:
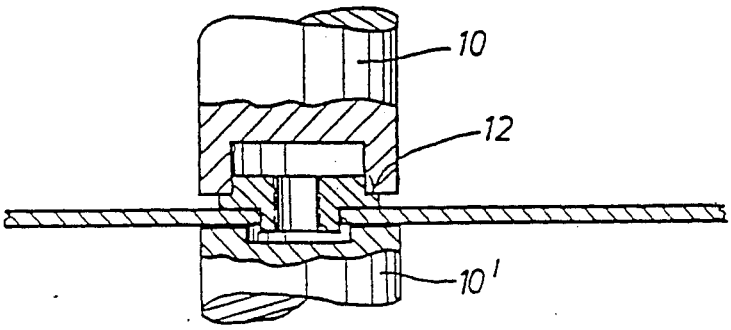

The electrical resistance welding of the weld-on nut causes the coating metal to be fused extremely rapidly by the high welding currents, and it is squeezed out in spark fashion from the abutment gap by the high electrode contact pressures. However, due to the offset 11 between the electrode abutment surface 12 and the contact surface 5, this flight of sparks is guided in the labyrinthine gap transversely past the contact surface 5, so that this contact surface 5 and its tinning remain totally undamaged. Any damage to the tinning in the region of the electrode abutment surface 12 can be tolerated because the weld-on nut is typically painted in this region in a subsequent painting operation. The contact surface 5 is simply covered with a rubber mushroom during the painting.

In order to assemble the grounding terminal, a grounding strap 2 is fastened by means of a fastening screw 3 and of a washer 7 to the contact surface 5 of the weld-on nut, so that by virtue of the clean metal conductive surface, and by virtue of the high contact pressure, a highly electrically conductive contact is generated which retains its good contacting characteristic and is protected from rust for a period of years.

Although the invention has been described in detail with reference to certain preferred embodiments and specific examples, variations and modifications exist within the scope and spirit of the invention as described and defined in the following claims.

What is claimed is:

1. Weld-on nut for grounding a terminal to a metal ground, including nut body means with a bore having a longitudinal axis, said nut body means having a first side for contacting said metal ground and a second side for contacting both said grounding terminal and a welding electrode surface, said second side comprising:

an annular contact surface for contacting said grounding terminal, said contact surface being coated with an anti-corrosive metal coating;

at least one annular electrode contacting surface for contacting said welding electrode surface, said at least one electrode contacting surface being non-coplanar with said contact surface, said non-coplanar arrangement of said contact surface and said electrode contacting surface being capable of protecting said anti-corrosive coating from damage due to spattering during a welding operation, said annular contact surface and said annular electrode contacting surface having longitudinal axes common with said nut bore longitudinal axis.

2. A weld-on nut according to claim 1, wherein said nut body contains an axial bore extending transversely to said contact surface.

3. A welding nut according to claim 1, wherein said contact surface comprises a central surface and said electrode contacting surface comprises an outer surface surrounding said central surface.

4. A weld-on nut according to claim 3, wherein said outer surface comprises an annular flange.

5. A weld-on nut according to claim 1, wherein said electrode contacting surface is offset from said contact surface toward said first side of said nut body.

6. A weld-on nut according to claim 5, wherein said electrode contacting surface is contained in a first plane and said contact surface is contained in a second plane, said first and second planes being substantially parallel.

* * * * *